US009931534B2

(12) United States Patent
Huang

(10) Patent No.: US 9,931,534 B2
(45) Date of Patent: Apr. 3, 2018

(54) ELLIPTICAL TRAINER WITH VARIABLE STRIDE

(71) Applicant: REXON INDUSTRIAL CORP., LTD., Taichung (TW)

(72) Inventor: Ming-Cheng Huang, Taichung (TW)

(73) Assignee: REXON INDUSTRIAL CORP. LTD., Taichung (TW)

( * ) Notice: Subject to any disclaimer, the term of this patent is extended or adjusted under 35 U.S.C. 154(b) by 0 days.

(21) Appl. No.: 15/224,920

(22) Filed: Aug. 1, 2016

(65) Prior Publication Data

US 2017/0028248 A1 Feb. 2, 2017

(30) Foreign Application Priority Data

Jul. 31, 2015 (TW) ..... 104124940 A

(51) Int. Cl.
*A63B 21/015* (2006.01)
*A63B 21/055* (2006.01)
(Continued)

(52) U.S. Cl.
CPC ..... *A63B 22/0664* (2013.01); *A63B 22/001* (2013.01); *A63B 22/0017* (2015.10);
(Continued)

(58) Field of Classification Search
CPC ..... A63B 21/00058; A63B 21/00061; A63B 21/00065; A63B 21/00069; A63B 21/00072; A63B 21/00076; A63B 21/00185; A63B 21/00192; A63B 21/0005; A63B 21/0051; A63B 21/0052; A63B 21/0056; A63B 21/012; A63B 21/0125; A63B 21/015; A63B 21/018; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/159; A63B 21/22; A63B 21/225; A63B 21/4027; A63B 21/0433; A63B 21/4034; A63B 21/4035; A63B 21/4045;
(Continued)

(56) References Cited

U.S. PATENT DOCUMENTS 6,045,487 A * 4/2000 Miller ..... A63B 21/00178 482/51
6,340,340 B1 * 1/2002 Stearns ..... A63B 21/15 482/52
(Continued)

*Primary Examiner* — Loan H Thanh
*Assistant Examiner* — Gary D Urbiel Goldner
(74) *Attorney, Agent, or Firm* — Bacon & Thomas, PLLC

(57) ABSTRACT

An elliptical trainer with variable stride includes a base frame, a swing unit axially mounted at the base frame, a pedal unit axially mounted at the swing unit, a damping unit for providing damping resistance to the swing unit, and a constraining unit including an axle axially mounted at the base frame, a pair of upper cranks respectively affixed to two opposite ends of the axle and a pair of coupling members respectively pivotally coupled between the upper cranks and the swing unit. Mating the constraining unit with the swing unit prevents the swing unit from overswinging, enhancing user safety.

8 Claims, 5 Drawing Sheets

(51) Int. Cl.

| | |
|---|---|
| ***A63B 21/22*** | (2006.01) |
| ***A63B 22/00*** | (2006.01) |
| ***A63B 22/06*** | (2006.01) |
| ***A63B 22/20*** | (2006.01) |
| ***A63B 23/035*** | (2006.01) |
| ***A63B 71/00*** | (2006.01) |
| *A63B 71/02* | (2006.01) |

(52) U.S. Cl.
CPC ..... *A63B 22/0605* (2013.01); *A63B 22/20* (2013.01); *A63B 23/0355* (2013.01); *A63B 23/03516* (2013.01); *A63B 23/03525* (2013.01); *A63B 21/015* (2013.01); *A63B 21/0552* (2013.01); *A63B 21/225* (2013.01); *A63B 22/0056* (2013.01); *A63B 22/201* (2013.01); *A63B 22/203* (2013.01); *A63B 2022/0676* (2013.01); *A63B 2071/0072* (2013.01); *A63B 2071/025* (2013.01); *A63B 2210/50* (2013.01)

(58) Field of Classification Search
CPC ..... A63B 21/4047; A63B 21/4049; A63B 22/0002; A63B 22/001; A63B 22/0015; A63B 22/0017; A63B 22/0046; A63B 22/0048; A63B 22/0056; A63B 22/06; A63B 22/0605; A63B 22/0664; A63B 22/0694; A63B 22/20; A63B 22/201; A63B 22/203; A63B 22/205; A63B 2022/067; A63B 2022/0676; A63B 23/035; A63B 23/03516; A63B 23/03525; A63B 23/03533; A63B 23/0355; A63B 23/03575; A63B 23/04; A63B 23/0405; A63B 23/0417; A63B 23/0423; A63B 23/0429; A63B 23/0476; A63B 23/0482; A63B 23/0494; A63B 23/12; A63B 23/1209; A63B 23/1245; A63B 23/1263; A63B 23/1281; A63B 69/0035; A63B 69/0018; A63B 69/182; A63B 2069/0031; A63B 2069/0033; A63B 71/0054; A63B 2071/0063; A63B 2071/0072; A63B 2071/0081; A63B 2071/009; A63B 2208/02; A63B 2208/0204; A63B 2210/50; A63B 2210/52; A63B 2225/09; A63B 2225/093; A63B 2244/19
See application file for complete search history.

(56) References Cited

U.S. PATENT DOCUMENTS

| | | | | |
|---|---|---|---|---|
| 6,454,682 | B1 * | 9/2002 | Kuo | A63B 22/001 482/52 |
| 6,758,790 | B1 * | 7/2004 | Ellis | A63B 22/001 482/52 |
| 7,462,134 | B2 * | 12/2008 | Lull | A63B 22/0015 482/52 |
| 7,507,184 | B2 * | 3/2009 | Rodgers, Jr. | A63B 21/154 482/51 |
| 7,641,598 | B2 * | 1/2010 | Rodgers, Jr. | A63B 21/151 482/52 |
| 7,678,025 | B2 * | 3/2010 | Rodgers, Jr. | A63B 21/151 482/52 |
| 7,878,947 | B1 * | 2/2011 | Rodgers, Jr. | A63B 21/00181 482/51 |
| 7,988,600 | B2 * | 8/2011 | Rodgers, Jr. | A63B 22/001 482/52 |
| 8,668,627 | B2 * | 3/2014 | Eschenbach | A63B 21/00069 482/51 |
| 2004/0053748 | A1 * | 3/2004 | Lo | A63B 22/0007 482/52 |
| 2004/0248705 | A1 * | 12/2004 | Rodgers, Jr. | A63B 22/001 482/83 |
| 2004/0248707 | A1 * | 12/2004 | Rodgers, Jr. | A63B 22/001 482/83 |
| 2004/0248711 | A1 * | 12/2004 | Rodgers, Jr. | A63B 22/001 482/86 |
| 2005/0049117 | A1 * | 3/2005 | Rodgers, Jr. | A63B 22/001 482/52 |
| 2007/0087907 | A1 * | 4/2007 | Rodgers, Jr. | A63B 21/05 482/52 |
| 2007/0219062 | A1 * | 9/2007 | Rodgers | A63B 21/151 482/52 |
| 2008/0227602 | A1 * | 9/2008 | Stearns | A63B 22/001 482/52 |
| 2015/0057129 | A1 * | 2/2015 | Lo | A63B 22/0664 482/52 |
| 2015/0375030 | A1 * | 12/2015 | Yang | A63B 21/015 482/52 |

* cited by examiner

ELLIPTICAL TRAINER WITH VARIABLE STRIDE

BACKGROUND OF THE INVENTION

1. Field of the Invention

The present invention relates to fitness equipment technology and more particularly, to an elliptical trainer with variable stride. Priority is claimed for Taiwan application No. 104124940 filed Jul. 31, 2015, the entire disclosure of which is herein incorporated by reference.

2. Description of the Related Art

U.S. Pat. No. 7,985,165, the entire disclosure of which is herein incorporated by reference, discloses an elliptical trainer, entitled "elliptical exercise machine", which comprises a base frame, a flywheel set axially mounted at the base frame, two swinging rods pivotally connected to the base frame, two pedal sets respectively pivotally connected to the bottom ends of the swinging rods, two rockers respectively pivotally connected between the pedal sets and the base frame, and two crank sets respectively pivotally connected between the flywheel set and the pedal sets.

When the user keeps stepping on the pedal sets, the crank sets drive the flywheel set to rotate and to further produce a damping resistance, thereby achieving the purpose of the exercise. Further, using the cranks set to move the pedal sets alternatively back and forth allows the user to conducting stepping exercises. Further, the rockers mate with the pedal sets to create a back and forth swinging motion.

The aforesaid prior art elliptical trainer can achieve the expected purpose of use, and the matching arrangement of the crank sets, the pedal sets and the rockers can limit the operating stroke, however, because the rockers are mounted at the rear side of the base frame, a braking force can be produced and applied to the rockers when the user operates the pedal sets to heavily move the swinging rods, causing the rockers to bear a high stress, adversely affecting their lifespan.

SUMMARY OF THE INVENTION

The present invention has been accomplished with the above the circumstances in view. It is a main object of the present invention to provide an elliptical trainer with variable stride, which avoids mechanical damage due to overswinging.

To achieve this and other objects of the present invention, an elliptical trainer with variable stride has been developed. The elliptical trainer of the present invention comprises a base frame, a swing unit, a pedal unit, a damping unit and a constraining unit.

The base frame comprises a base, and an upright support unit fixedly mounted at the base.

The swing unit comprises a pair of swing arms pivotally connected to the upright support unit and is swingable back and forth relative to the upright support. Each swing arm comprises a tubular pivot connection portion pivotally connected to the upright support, and a swinging portion opposite to the tubular pivot connection portion.

The pedal unit comprises a pair of stepping bars respectively pivotally connected to the swing arms. Each stepping bar comprises a front end portion pivotally connected to one respective swinging portion, and a rear end portion opposite to the front end portion.

The damping unit is adapted for providing swing damping to the stepping bars, comprising a rotating wheel. The rotating wheel comprises a pivot shaft axially mounted at the base frame.

The constraining unit comprises an axle axially mounted at the base frame, a pair of upper cranks respectively affixed to two opposite ends of the axle in reversed directions, and a pair of coupling members respectively pivotally coupled between the respective upper cranks and the tubular pivot connection portions of the respective swing arm.

Thus, the present invention has the advantages of: subject to the mating arrangement between the constraining unit, the base frame and the swing unit, the swinging of the swing unit is well controlled, avoiding mechanical damage due to overswinging. Further, the constraining unit restricts the travel distance of the swinging unit, enhancing user safety.

DETAILED DESCRIPTION OF THE INVENTION

Figure 1:
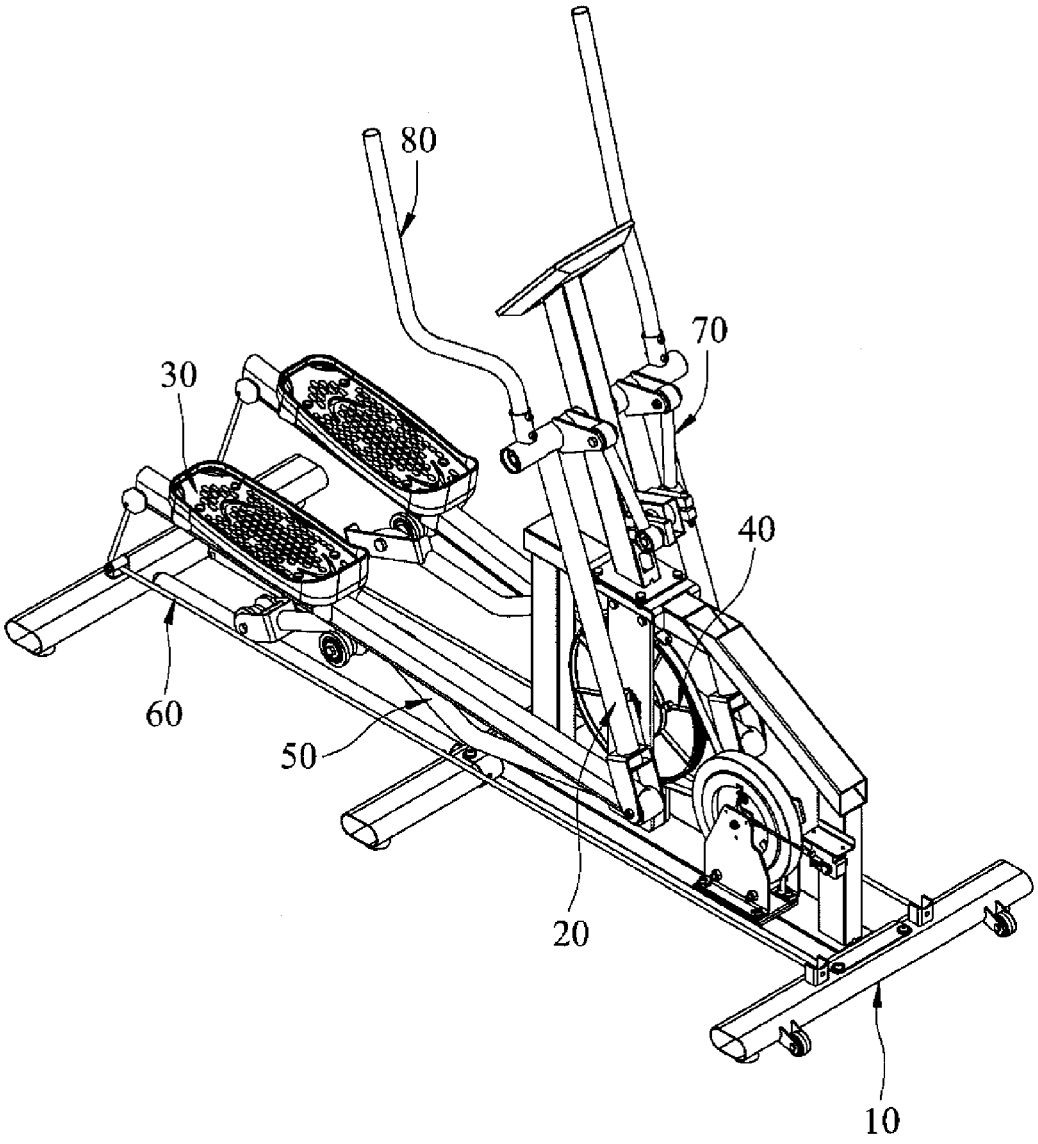
FIG. 1 is an oblique top elevational view of an elliptical trainer with variable stride in accordance with the present invention.
Figure 2:
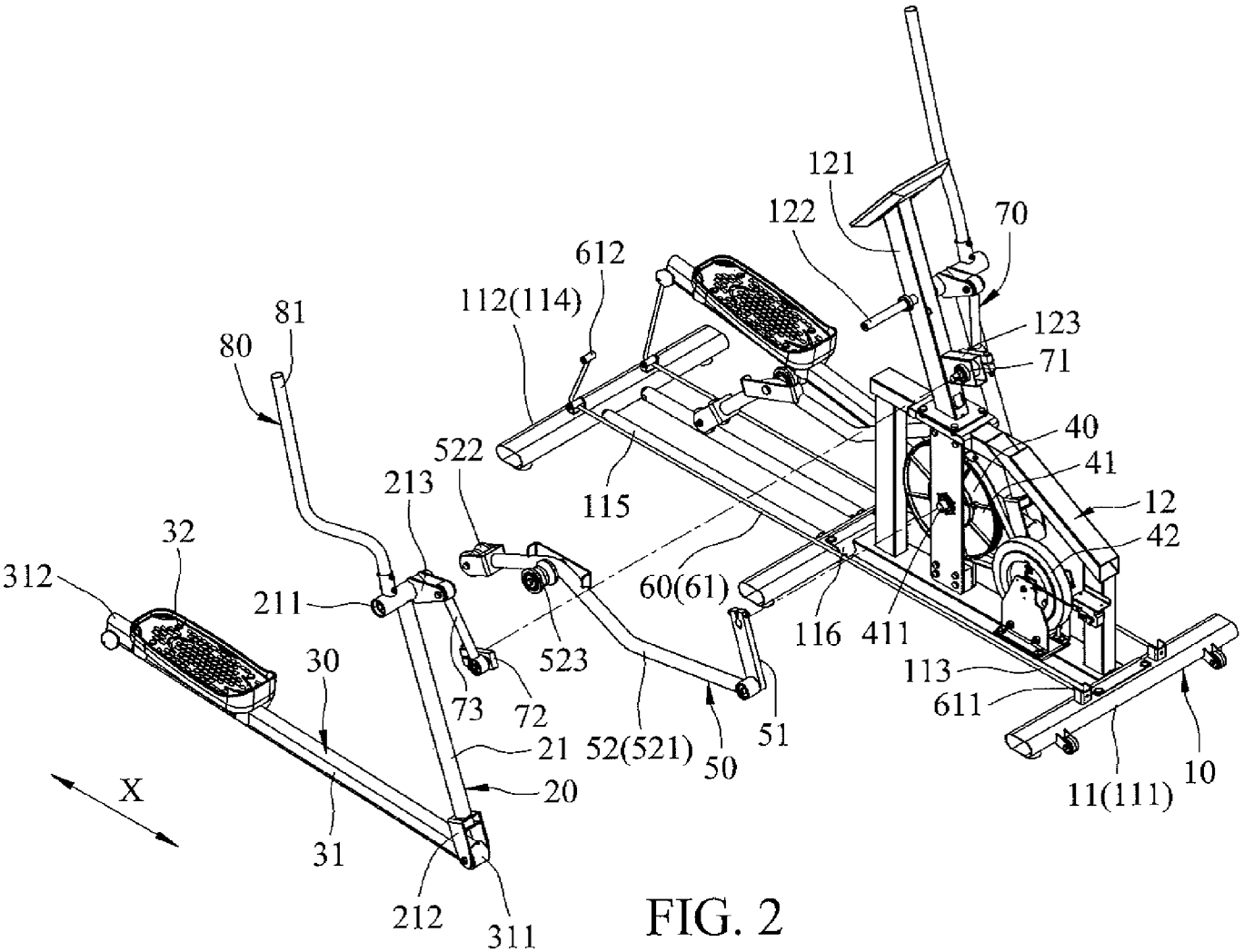
FIG. 2 is an exploded view of the elliptical trainer with variable stride in accordance with the present invention.
Figure 3:
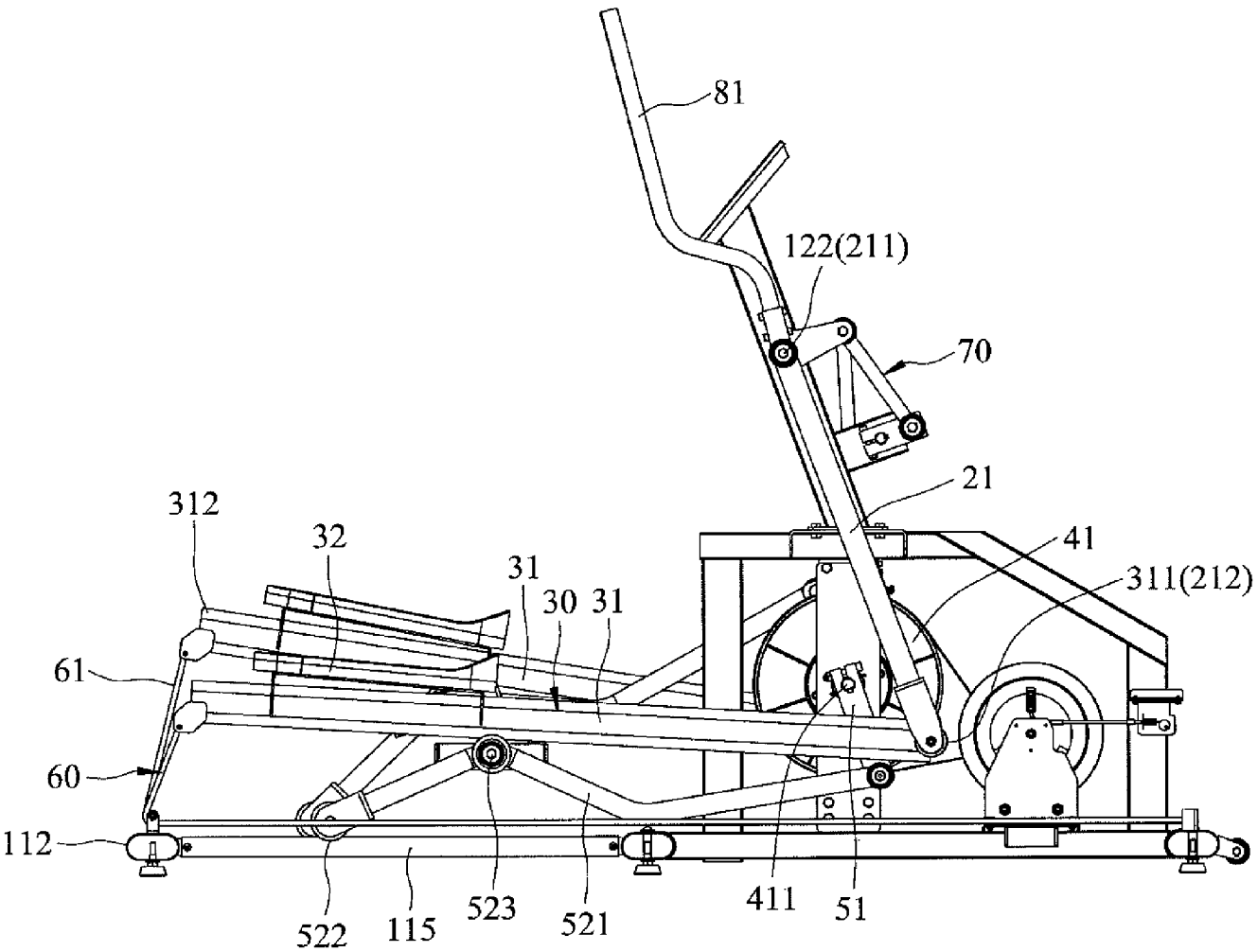
FIG. 3 is a schematic side plan view of the elliptical trainer with variable stride in accordance with the present invention.

Referring to FIGS. 1, 2 and 3, an elliptical trainer with variable stride in accordance with the present invention, is shown. The elliptical trainer comprises a base frame 10, a swing unit 20, a pedal unit 30, a damping unit 40, a guiding unit 50, an elastic device unit 60, a constraining unit 70, and a handlebar unit 80.

The base frame 10 comprises a base 11, and an upright support unit 12 fixedly mounted at the base 11. The base 11 comprises a front side 111, a rear side 112 opposite to the front side 111, an approximately centrally located transverse section 116, and a front bottom frame member 113 located at the front side 111. The rear bottom bar 114 is located at the rear side 112, and a pair of guide members 115 extend along the horizontal axis X and connect between the front bottom frame member 113 and the rear bottom bar 114.

The upright support unit 12 is located at the front side 111 of the base 11 and is connected to the front bottom frame member 113, comprising an upright post 121 located at a top side thereof. A transverse axle 122 is located at the upright post 121, and an extension bar 123 downwardly extends from the transverse axle 122.

The guide members 115 are elongated rods, having a circular cross section perpendicular to the horizontal axis X.

The swing unit 20 comprises a pair of swing arms 21 axially pivotally connected to the transverse axle 122 of the upright post 121 and alternatively movable back and forth relative to the base frame 10. Each swing arm 21 comprises a tubular pivot connection portion 211 located at one end thereof and pivotally connected to respective one end of the transverse axle 122. A swinging portion 212 is located at an opposite end thereof, and a lug member 213 is located at the tubular pivot connection portion 211.

The pedal unit 30 comprises a pair of stepping bars 31 respectively pivotally connected to the swing arms 21 of the swing unit 20, and a pair of pedals 32 is respectively mounted at the stepping bars 31. Each stepping bar 31 comprises a front end portion 311 pivotally connected to the swinging portion 212 of one respective swing arm 21, and has an opposing rear end portion 312. The pedals 32 are respectively mounted at the rear end portions 312 of the stepping bars 31.

The damping unit 40 is configured to provide a damping resistance to the stepping bars 31. The damping unit 40, comprises a rotating wheel 41 rotatably mounted in the upright support unit 12 and includes a damping wheel 42 rotatable by the rotating wheel 41. The rotating wheel 41 comprises a pivot shaft 411 axially located at the center and axially mounted in the upright support unit 12.

The guiding unit 50 comprises a pair of cranks 51 respectively connected to two opposite ends of the pivot shaft 411 and disposed at two opposite lateral sides relative to the rotating wheel 41. Also included is a pair of guide brackets 52 respectively pivotally connected to the cranks 51. Each guide bracket 52 comprises a curved guide rod 521 pivotally connected to the associated crank 51. A guide wheel 522 is pivotally mounted at the distal end of the curved guide rod 521 remote from the associated crank 51 and slidably coupled to one respective guide member 115 of the base frame 10.

A bearing member 523 is axially disposed between the associated guide wheel 521 and the associated crank 51 for supporting one respective stepping bar 31. The bearing members 523 in this embodiment are rollers respectively disposed between the front end portions 311 and rear end portions 312 of the respective stepping bars 31 and axially mounted on the respective curved guide rods 521, at an inner side relative to the respective guide wheels 522.

The elastic device unit 60 comprises a pair of elastic members 61 respectively connected between the base frame 10 and the stepping bars 31. The elastic potential energy of the elastic members 61 constantly keeps the rear end portions 312 of the respective stepping bars 31 in proximity to the base frame 10 and the respective stepping bars 31 in proximity to the respective bearing members 523, reducing the moving speed of the respective stepping bars 31, enhancing user safety and facilitating alternating stepping. In this embodiment, the elastic members 61 are elastic ropes, each having one end thereof terminating in a fixed end portion 611 that is connected to the front side of the front bottom frame member 113 of the base frame 10 and an opposite end thereof terminating in a pull detent end portion 612 that is connected to the rear end portion 312 of one respective stepping bar 31.

The constraining unit 70 comprises an axle 71 axially mounted at the extension bar 123, a pair of upper cranks 72 is respectively affixed to the two opposite ends of the axle 71 in reversed directions, and a pair of coupling members 73 respectively pivotally coupled between the respective upper cranks 72 and the respective lug members 213 to restrict the travel distance of the swing arms 21.

The handlebar unit 80 comprises two handlebars 81 respectively connected to the swing arms 21 above the transverse axle 122.

Figure 4:
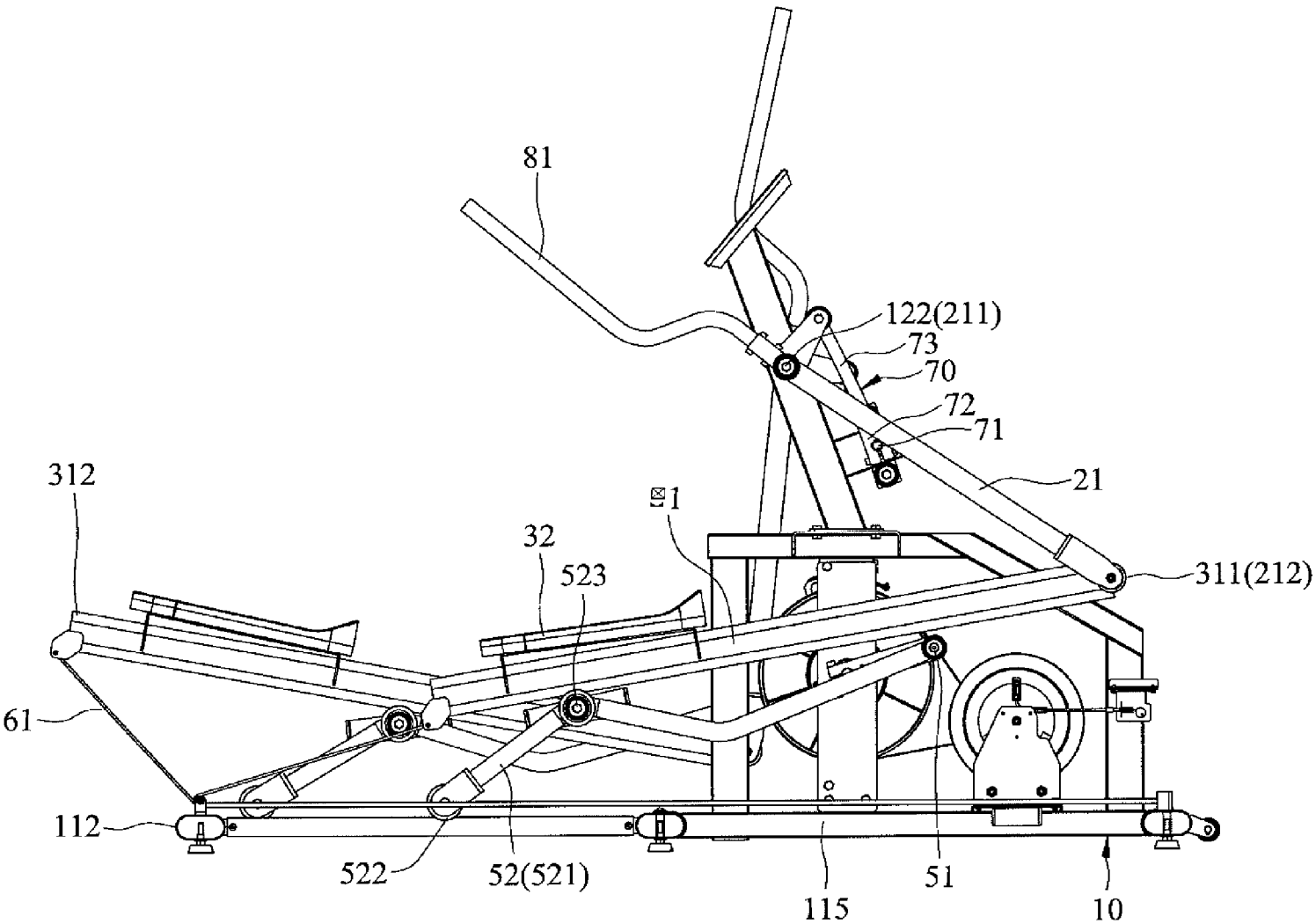
FIG. 4 is a schematic operational view of the present invention, illustrating one upper crank reaching the upper dead point position and the respective swing arm reaching the foremost position.
Figure 5:
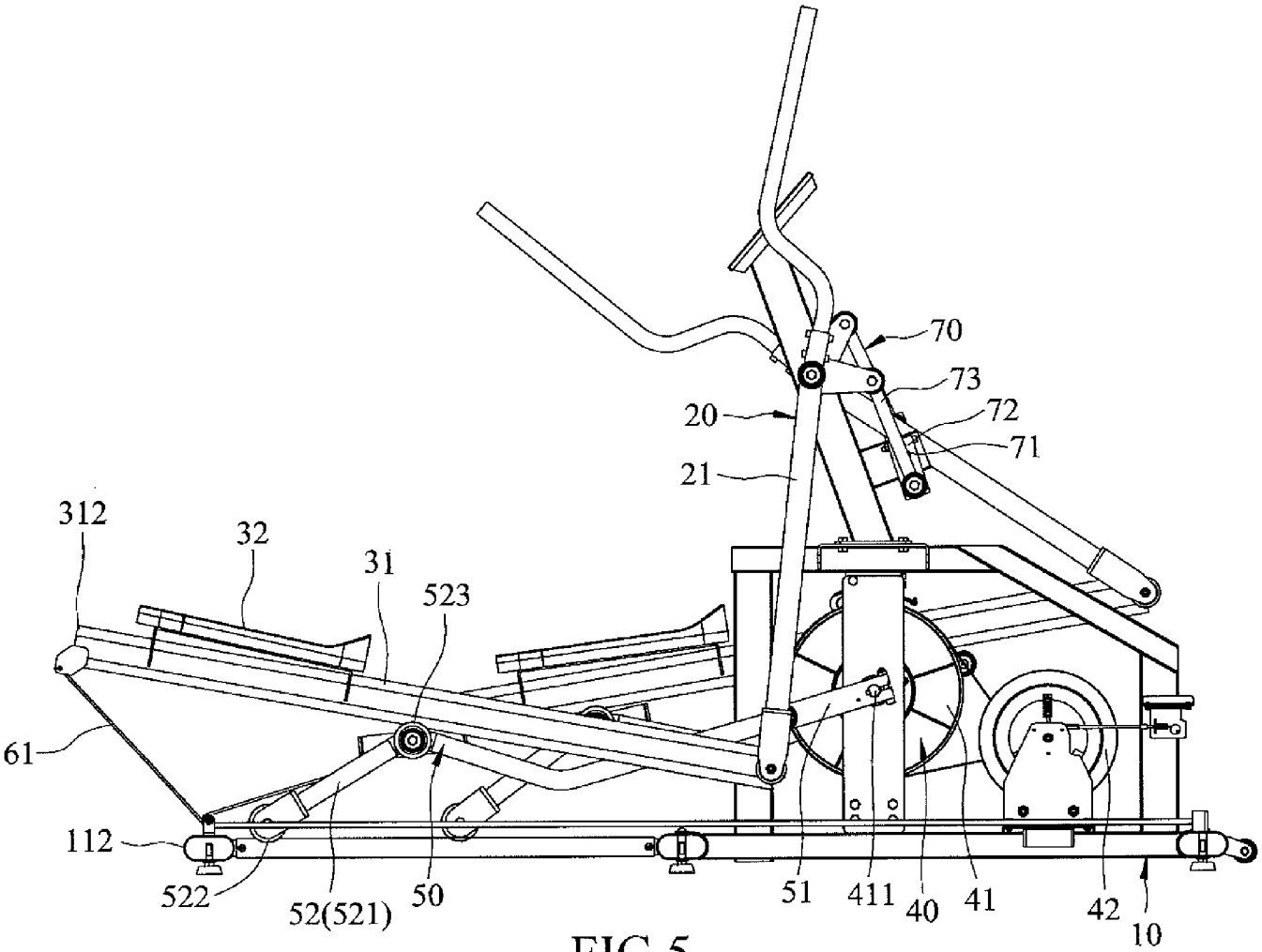
FIG. 5 is another schematic operational view of the present invention, illustrating the upper crank reaching the lower dead point position and the respective swing arm reaching the rearmost position.

When the user uses the elliptical trainer to carry out an operating mode of free stepping and/or elliptical trajectory, as shown in FIGS. 3, 4 and 5, the user uses his/her two legs to give force to the pedals 32 and the stepping bars 31 horizontally forwards and vertically downwards in an alternative manner, forcing the front end portions 311 of the stepping bars 31 to move the swinging portions 212 of the swing arms 21 and causing the swing arms 21 to turn back and forth about the transverse axle 122, and thus, the stepping bars 31, with the arrangement of the constraining unit 70, the swing arms 21 and the handlebars 81 travel within a predetermined range, preventing mechanical damage due to over movement of the swing arms 21 and the stepping bars 31.

That is to say, when the rear end portion 312 of one stepping bar 31 is approaching the rear side 112 of the base frame 10, as the user is alternatively stepping the stepping bars 31, the other stepping bar 31 is dragged by the respective crank 51 to move the rear end portion 312 thereof away from the rear side 112 of the base frame 10, thereby stretching the associated elastic member 61 to store elastic potential energy. Further, subject to the arrangement of the elastic device unit 60, the stepping bar 31 is pulled by the associated elastic member 61 toward the rear side 112 of the base frame 10 during its swinging motion. When the stepping bars 31 are alternatively stepped by the user, the guide wheels 522 are moved with the respective curved guide rods 521 along the respective guide members, and the cranks 51 are driven by the respective curved guide rods 521 to move the pivot shaft 411, causing rotation of the rotating wheel 41 (during the operation of the stepping bars 31, an inertial elastic force is produced subject to the elastic potential energy of the elastic members 61), and thus, the damping wheel 42 is rotated by the rotating wheel 41 to provide damping resistance.

Thus, subject to the arrangement of the elastic device unit 60, the elastic members 61 pull the respective stepping bars 31 in direction toward the rear side 112 of the base frame 10 when the stepping bars 31 are alternatively stepped by the user. The respective stepping bars 31 can be moved horizontally and vertically on the bearing members 523 of the respective guide brackets 52. Further, the guide wheels 522 of the guide brackets 52 of the guiding unit 50 are respectively supported on the respective guide members 115 of the base frame 10 so that the guide brackets 52 can be stably and smoothly moved along the respective guide members 115. By means of the cranks 51 to rotate the rotating wheel 41 and then the damping wheel 42, the desired damping resistance can be accurately produced, achieving exercise and fitness goals.

Further, as illustrated in FIG. 4, the arrangement of the constraining unit 70 can restrict the travel distance of the swing arms 21 and the stepping bars 31, i.e., when the upper crank 72 reaches the upper dead point position, the constraining unit 70 constrains the respective swing arm 21 and the respective stepping bar 31 to the foremost position. Further, as illustrated in FIG. 5, when the upper crank 72 reaches the opposing lower dead point position, the constraining unit 70 constrains the respective swing arm 21 and the respective stepping bar 31 to the rearmost position. Further, the constraining unit 70 directly restricts the travel distance of the swing arms 21 and the stepping bars 31, preventing mechanical damage due to that the swing arms 21 and the stepping bars 31 move too much and prolonging the lifespan of the elliptical trainer. Further, because the constraining unit 70 restricts the maximum travel distance of the swing arms 21 and the stepping bars 31, the present invention avoids over swinging and enhances user safety.

In addition to the aforesaid operating mode, the user can carry out a simple operating mode of stepping up and down. In this mode, the user uses his/her two legs to give force to the pedals 32 and the stepping bars 31 vertically and downwards, forcing the pedals 32 with the respective stepping bars 31 to alternatively impart a downward pressure to the bearing members 523 of the guide brackets 52. At this time, the damping unit 40 is caused by the guide brackets 52 to produce damping in vertical vector, and thus, the swing arms 21 are prohibited from swinging.

When the user is going to carry out a sliding operating mode, the user uses his/her two legs to give force to the pedals 32 and the stepping bars 31 horizontally forwards, forcing the front end portions 311 of the stepping bars 31 to move the swinging portions 212 of the swing arms 21 and causing the swing arms 21 to turn back and forth about the transverse axle 122, and the same time, a damping resistance in the horizontal vector is produced subject to the functioning of the elastic device unit 60.

Therefore, an operator can select the desired mode of operation according to one's own needs, such as: the operating mode of free stepping and elliptical trajectory, the sliding operating mode, or the simple operating mode of stepping up and down.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An elliptical trainer, comprising:

a base frame comprising a base, and an upright support unit fixedly mounted at said base;

a swing unit comprising a pair of swing arms pivotally connected to said upright support unit and swingable back and forth relative to said upright support unit, each said swing arm comprising a tubular pivot connection portion pivotally connected to said upright support unit and a swinging portion opposite to said tubular pivot connection portion;

a pedal unit comprising a pair of stepping bars respectively pivotally connected to said swing arms, each said stepping bar comprising a front end portion pivotally connected to one respective said swinging portion and a rear end portion opposite to said front end portion;

a damping unit adapted for providing swing damping to said stepping bars, said damping unit comprising a rotating wheel, said rotating wheel comprising a pivot shaft axially mounted at said base frame; and a constraining unit comprising an axle axially mounted at an extension bar on an upright post mounted to said upright support unit attached to said base frame, a pair of upper cranks respectively affixed to two opposite ends of said axle in reversed directions, and a pair of coupling members respectively pivotally coupled between the respective said upper cranks and the said tubular pivot connection portions of the respective said swing arms.

2. The elliptical trainer as claimed in claim 1, further comprising an elastic device unit, said elastic device unit comprising a pair of elastic members respectively connected between said base frame and said stepping bars for providing an elastic potential energy to constantly keep the said rear end portions of the respective said stepping bars in proximity to said base frame.

3. The elliptical trainer as claimed in claim 2, wherein said elastic members are elastic ropes, each said elastic rope having one end thereof terminating in a fixed end portion that is connected to a front side of said base frame and an opposite end thereof terminating in a pull detent end portion that is connected to the said rear end portion of one respective said stepping bar.

4. The elliptical trainer as claimed in claim 3, wherein said base of said base frame comprises a front side, a rear side opposite to said front side, and a pair of guide members extended along a horizontal axis from said rear side to said front side; said upright support unit is located at said front side of said base; the elliptical trainer further comprises a guiding unit, said guiding unit comprising a pair of cranks respectively connected to two opposite ends of said pivot shaft and disposed at two opposite lateral sides relative to said rotating wheel and a pair of guide brackets respectively pivotally connected to said cranks, each said guide bracket comprising a guide wheel slidably coupled to one respective said guide member of said base frame and a bearing member axially disposed between one respective said guide wheel and one respective said crank for supporting one respective said stepping bar, said bearing members respectively disposed between the said front end portions and said rear end portions of the respective said stepping bars; said elastic device unit is adapted for providing an elastic potential energy to constantly keep the respective said stepping bars in proximity to the respective said bearing members.

5. The elliptical trainer as claimed in claim 4, wherein each said guide bracket of said guiding unit further comprises a curved guide rod; said guide wheel of each said guide bracket is axially mounted at a distal end of the associated said curved guide rod; said bearing members of said guide brackets are rollers respectively and axially mounted on the respective said curved guide rods at an inner side of the respective said curved guide rods relative to the respective said guide wheels.

6. The elliptical trainer as claimed in claim 5, wherein said guide members of said base frame are elongated rods; said guide wheels of said guiding unit are mounted on and movable along the respective said guide members.

7. The elliptical trainer as claimed in claim 4, wherein the upright support unit comprises an upright front post, an upright rear post with a first substantially horizontal portion attached to a second downwardly sloping portion attached to the upright front post.

8. An elliptical trainer, comprising:

a base frame comprising a base, and an upright support unit fixedly mounted at said base;

a swing unit comprising a pair of swing arms pivotally connected to said upright support unit and swingable back and forth relative to said upright support unit, each said swing arm comprising a tubular pivot connection portion pivotally connected to said upright support unit and a swinging portion opposite to said tubular pivot connection portion;

a pedal unit comprising a pair of stepping bars respectively pivotally connected to said swing arms, each said stepping bar comprising a front end portion pivotally connected to one respective said swinging portion and a rear end portion opposite to said front end portion;

a damping unit adapted for providing swing damping to said stepping bars, said damping unit comprising a rotating wheel, said rotating wheel comprising a pivot shaft axially mounted at said base frame; and a constraining unit comprising an axle axially mounted at said base frame, a pair of upper cranks respectively affixed to two opposite ends of said axle in reversed directions, and a pair of coupling members respectively pivotally coupled between the respective said upper cranks and the said tubular pivot connection portions of the respective said swing arms and further comprising an elastic device unit, said elastic device unit comprising a pair of elastic members respectively connected between said base frame and said stepping bars for providing an elastic potential energy to constantly keep the said rear end portions of the respective said stepping bars in proximity to said base frame.

* * * * *